United States Patent [19]

DeWitt

[11] 4,269,354

[45] May 26, 1981

[54] WATER SPRINKLER

[76] Inventor: Robert E. DeWitt, 49 Sherwick Rd., Oswego, Ill. 60543

[21] Appl. No.: 51,861

[22] Filed: Jun. 25, 1979

Related U.S. Application Data

[63] Continuation-in-part of Ser. No. 893,268, Apr. 5, 1978, Pat. No. 4,180,210.

[51] Int. Cl.[3] ..... B05B 3/08

[52] U.S. Cl. ..... 239/97; 239/DIG. 1

[58] Field of Search ..... 239/97, 98, 230, DIG. 1

[56] References Cited

U.S. PATENT DOCUMENTS

| | | | |
|---|---|---|---|
| 1,618,538 | 2/1927 | Kittinger | 239/97 |
| 2,090,284 | 8/1937 | Carlson | 239/97 |
| 2,600,987 | 6/1952 | Gallice | 239/97 |
| 2,654,635 | 10/1953 | Lazzarini | 239/230 |
| 2,739,839 | 3/1956 | Greener et al. | 239/97 |
| 3,022,012 | 2/1962 | Sharp et al. | 239/230 |
| 3,884,416 | 5/1975 | King | 239/97 |
| 3,960,327 | 6/1976 | Olson | 239/97 |

FOREIGN PATENT DOCUMENTS

| | | | |
|---|---|---|---|
| 93509 | 3/1959 | Norway | 239/97 |

*Primary Examiner*—Robert W. Saifer

*Attorney, Agent, or Firm*—Cook, Wetzel & Egan, Ltd.

[57] ABSTRACT

A water sprinkler develops any of several predetermined patterns of water coverage of regular or irregular shape and of varying sizes. The sprinkler includes first a plurality of pattern-defining apertures which are contoured to pass varying but predetermined amounts of water from a fixed sampling aperture as a sprinkler nozzle rotates in either or both angular directions about a vertical axis.

Pattern size is incrementally adjustable in one embodiment by a member having tapered apertures of varying sizes interposed between the fixed sampling aperture and the pattern-defining apertures. Pattern size and shape are finely adjusted by a parallel flow line including a valve for providing small additional or slightly reduced flow volumes. Rounded patterns are effected entirely through the parallel flow line.

17 Claims, 18 Drawing Figures

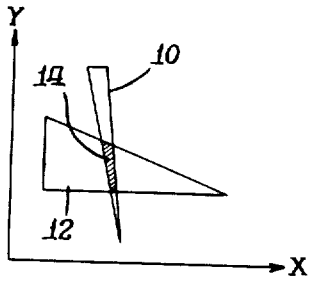
Fig. 1.
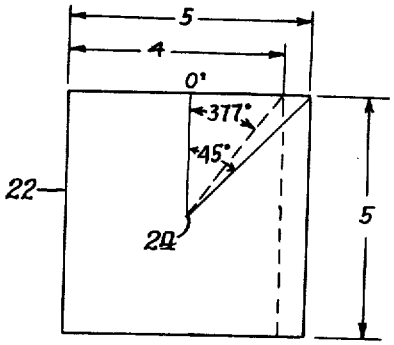
Fig. 3.
Fig. 2.
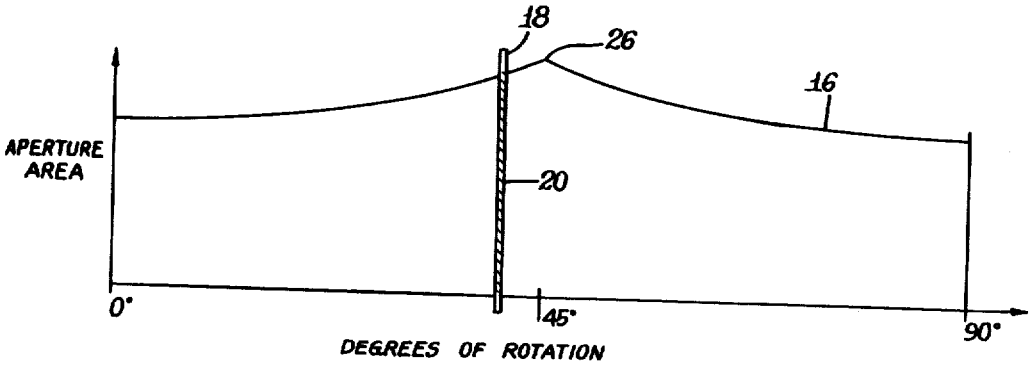
Fig. 4.
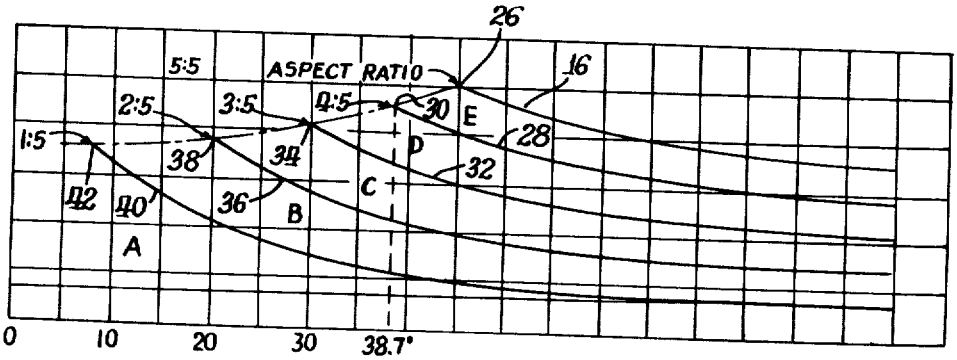

Fig. 5.
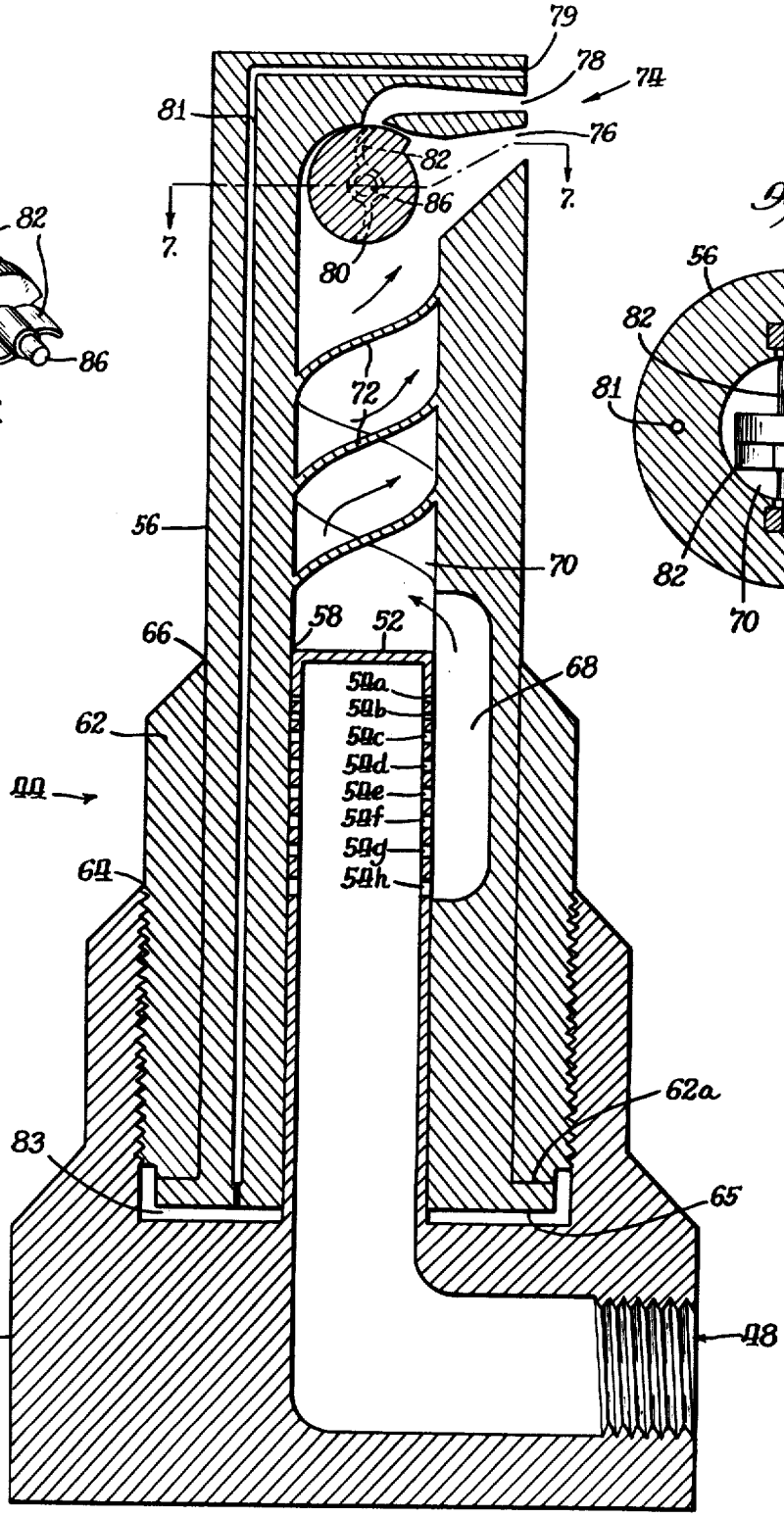
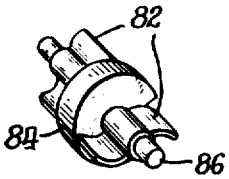
Fig. 6.
Fig. 7.
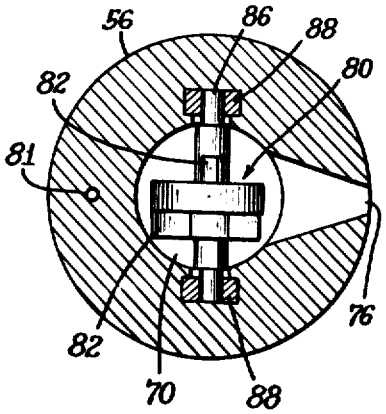

WATER SPRINKLER

This application is a continuation-in-part of my copending application Ser. No. 893,268, filed Apr. 5, 1978, now issued as U.S. Pat. No. 4,180,210.

This invention relates generally to water sprinklers and particularly to water sprinklers for producing a predetermined but variable pattern of water coverage.

Most known water sprinklers have been designed to produce only a single pattern of water coverage, generally either circular or rectangular. To conform the pattern of water coverage to the shape and area of a yard to be sprinkled, the only variables which can generally be adjusted are the location of the sprinkler and the water pressure received by the sprinkler. However, many yards are irregular in shape, thus making it difficult, if not impossible, to conform completely the pattern of water coverage to the size and geometry of the yard. Further, in some instances it is desirable to sprinkle only a selected portion of a yard or garden, and yet the pattern of water coverage cannot be accurately conformed to the geometry of the area to be sprinkled. Consequently, either some water is wasted in covering areas not desired to be sprinkled or the water coverage must be reduced to cover only a portion of the desired area. In either case, the results are not entirely satisfactory.

To generate an irregular pattern of water converage, a water sprinkler has been proposed whose coverage is defined by a plate having an orifice with a geometry corresponding to the geometry of water coverage desired. Thus, the geometry of the orifice defines the pattern of water coverage, See U.S. Pat. No. 4,019,086, for example. In U.S. Pat. No. 2,739,839, a fixed sleeve with control ports and a rotating axle with a continuous inlet and auxillary ports defines added areas about a circular pattern to be sprinkled. Adjustment screws permit some of the control ports to be partly blocked to vary the spray pattern. A problem with the sprinkler proposed in the first aforementioned patent is that the sprinkler must be disassembled each time the pattern of water coverage is to be changed substantially. That is, if the pattern of water coverage is to be changed from circular to rectangular, for example, a plate having a circular orifice must be removed and replaced by a plate having a rectangular orifice. In the second patent, up to eight screws and eight lock nuts must be adjusted, or a new control sleeve must be inserted, to adjust the water spray coverage pattern. As a result, in either case it is inconvenient to change the pattern of water coverage.

Such problems associated with prior water sprinklers make it inconvenient, if not impossible, to vary the pattern of water coverage to effect a desired pattern. In addition, much water is frequently wasted by sprinking outside a desired area of coverage.

Accordingly, it is an object of this invention to provide an improved water sprinkler.

It is a more particular object of the invention to provide a water sprinkler whose water pattern coverage is easily variable, which can effect many desired coverages with simple adjustments to achieve irregular patterns of coverage in various sizes using a reciprocating spray head.

In accordance with the present invention, the improved water sprinkler described herein has an inlet port for receiving water and a rotatable and/or reciprocable water outlet port or nozzle for distributing the water in a predetermined, regular or irregular pattern of water coverage. A flow regulator is disposed between the inlet port and the outlet port to produce the desired pattern of water coverage. The flow regulator has at least one and preferably a plurality of cooperable pattern-defining apertures for passing water and a pattern sampling aperture communicating with the pattern-defining aperture. As the outlet port angularly rotates or reciprocates, relative motion between the pattern-defining apertures and the sampling aperture is effected for sampling successive portions of the pattern-defining apertures synchronously with the rotation or reciprocation of the outlet port or nozzle.

FIG. 1 is a schematic view illustrating a pair of relatively movable orifices having a common overlapping area, useful in describing the theory of operation of the invention.

FIG. 2 is a schematic view illustrating another pair of relatively movable orifices having a common overlapping area, useful in describing the way in which a rectangular pattern of water coverage may be obtained.

FIG. 3 is a schematic view illustrating a pair of rectangular water pattern coverages obtainable using the type of orifices shown in FIG. 2.

FIG. 4 is a schematic chart illustrating a way in which one of the orifices of FIG. 2 may be segmented to provide rectangular water pattern coverages of various aspect ratios.

FIG. 5 is a sectional view of a first water sprinkler according to one embodiment of the invention.

FIG. 6 is a perspective view of a water diffusing wheel, for use with the embodiment of FIG. 5.

FIG. 7 is a sectional view taken along line 7—7 of FIG. 5.

Figure 12:
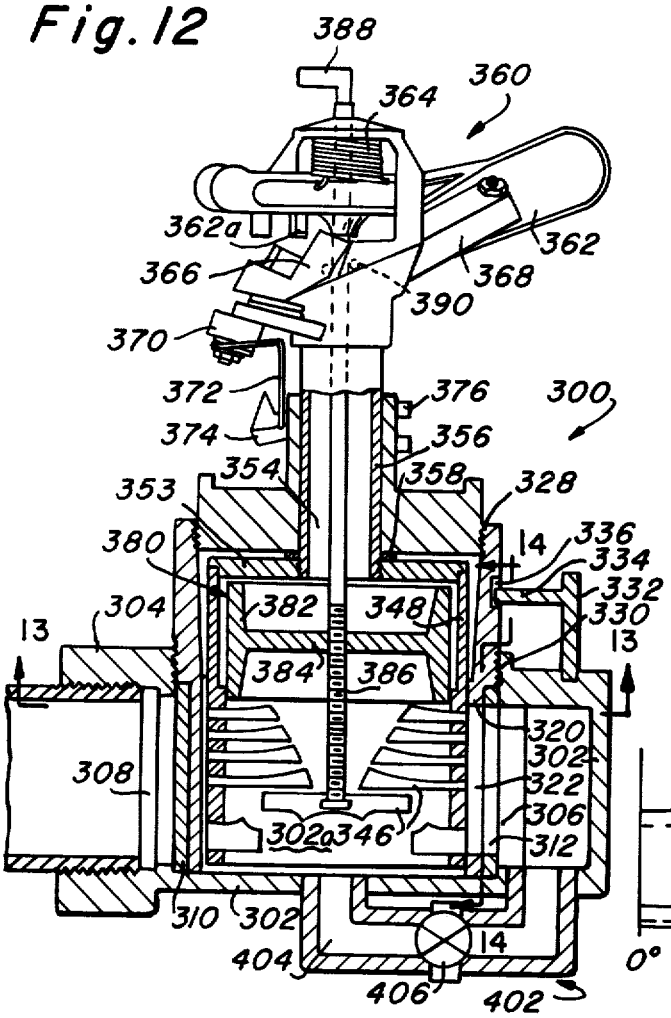
FIG. 12 is a side view, mostly in section, of a conventional, reciprocating spray head nozzle with, in section, a third embodiment of a sprinkler control mechanism in accordance with the invention.
Figure 18:
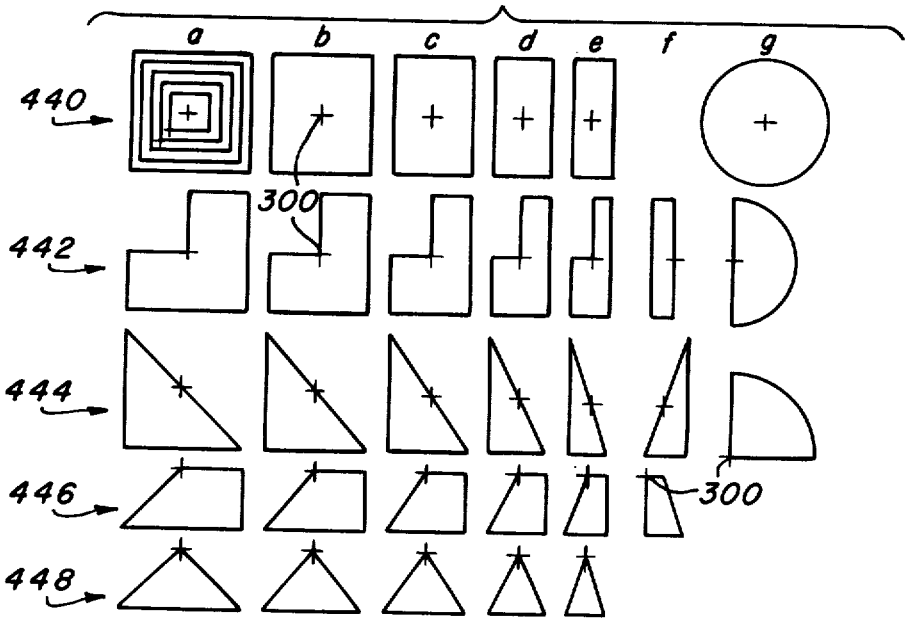

Finally, FIG. 18 depicts a number of patterns of water spray coverage effected using the sprinkler of FIG. 12.

Referring first to FIG. 1, at least one of a pair of theoretical apertures 10 and 12 is movable in a first direction X so that the mutual area of overlap 14 (the cross-hatched area) of the apertures 10 and 12 is a function of their relative positions. If the apertures 10 and 12 are ports situated such that water can flow only through the overlapping area 14, the rate of flow of water through them will be dependent on the size of the overlapping area 14. Hence, the rate of flow of water will vary as the aperture 10 is moved along the X or Y directions.

Applying this principle to a water sprinkler, a pair of apertures 16 and 18 is shown in FIG. 2 for generating a rectangular pattern of water coverage. Hereinafter, the aperture 16 is referred to as a pattern-defining aperture because its shape determines the ultimate pattern of water coverage. Also, the aperture 18 is referred to as a sampling aperture because it samples successive portions of the aperture 16.

As shown, the pattern-defining aperture 16 extends between zero and 90°, corresponding to similar angles of rotation of a rotatable sprinkler nozzle. Thus, movement of the sampling aperture 18 from zero to 90° corresponds to 90° rotation of a sprinkler nozzle. Of course, a sprinkler nozzle will normally rotate through 360°, and additional apertures 16 may be included to permit sampling throughout 360° of rotation.

If the apertures 16 and 18 are disposed such that water can only flow through an area 20 defined by the overlaping between the apertures 16 and 18, then the flow of water through the overlap area 20 will depend on the position of the aperture 18 with respect to the aperture 16. Specifically, when the aperture 18 is located at the zero degree location, the area 20 will be minimum and the flow of water through the area 20 will be minimum. As the aperture 18 moves to the right, the flow of water will gradually increase to a maximum at the 45° position. Further the movement of the apparatus 18 to the right will cause the flow of water through the area 20 gradually to decrease to another minimum at the 90° position. Now, if the water which passes through the overlap area 20 is conducted to a rotatable outlet nozzle, and the movement of the aperture 18 is synchronized to the rotation of the outlet nozzle, the flow of water from the nozzle will vary with the angular position of the nozzle to develop a water pattern coverage related to the shape or contour of the pattern-defining structure 16.

The pattern-defining aperture 16 will develop a water pattern coverage corresponding to one quadrant of a square. For example, referring to FIG. 3, the aperture 16 will develop a water pattern coverage corresponding to the upper right quadrant of the square 22. That is, if the water outlet nozzle is located at the center 24 of the square 22, synchronous rotation of the outlet nozzle and the sampling aperture 18 between zero degrees and 90° will generate a water pattern coverage corresponding to one quadrant of a square. To develop a water pattern coverage corresponding to a full square, three more pattern-defining apertures, all identical to aperture 16, would be laid side-by-side to the right of aperture 16, and the sampling aperture 18 would sweep across all four pattern-defining apertures in synchronism with 360° rotation of the outlet nozzle. This operation would generate a water pattern coverage corresponding to the square 22.

An advantage in using the type of pattern-defining aperture and sampling aperture depicted in FIG. 2 is that the aspect ratio of the water pattern coverage may be easily changed. For example, if the peak 26 of the aperture 16 is moved to the left to a position corresponding to 38.7°, a rectangular water pattern coverage having an aspect ratio of 4:5 will be obtained. This is also shown in FIG. 3 wherein one corner of the 4:5 rectangle occurs at 38.7°. Of course, four such pattern-defining apertures would be used to develop the complete rectangle.

FIG. 4 shows more explicitly how the pattern-defining aperture 16 may be modified to develop rectangular water pattern coverage of various aspect ratios. Specifically, the aperture 16 has a peak 26 at the 45 location for developing one quadrant of a square pattern of water coverage. The pattern defining aperture 28 has a peak 30 at a location of 38.7° for developing a rectangular water pattern coverage with an aspect ratio of 4:5. The pattern-defining aperture 32 has a peak 34 at approximately 21 for developing a rectangular water pattern coverage having an aspect ratio of 2:5. The pattern-defining aperture 40 has a peak 42 at approximately 8° for developing a rectangular water pattern coverage having an aspect ratio of 1:5.

If any one of the apertures 16, 28, 32, 36, or 40 is sampled individually as by the sampling aperture of FIG. 2, a rectangular pattern of water coverage of a given aspect ratio is developed. However, the aperture 16 may be segmented as described below for cummulative sampling of apertures.

Specifically, the aperture 16 may be broken down into individual segment A-E shown, the segment A corresponding to the aperture 40. Thus, when only segment A is sampled, a rectangular pattern of water coverage having an aspect ratio of 1:5 is developed. Similarily, when segments A and B are sampled simultaneously (cumulatively), a rectangular pattern of coverage having an aspect ratio of 2:5 is developed. Similarly, when segments A through E are sampled simultaneously, a rectangular pattern of coverage having an aspect ratio of 5:5 is developed.

The significance of having various aperture segments which may be simultaneously sampled is that those segments may be physically spaced from each other while yet providing a composite pattern coverage when they are sampled simultaneously. In addition, the need for apertures which individually develop the patterns of differenct aspect ratios is eliminated, since the smaller segments may be sampled cumulatively to develop the same patterns. Hence, less space is required.

The apertures described in the first embodiment below are contoured differently from those shown in FIG. 4, but they make use of the same principle of sampling segmented apertures to develop not only rectangular patterns of water coverage, but triangular and circular patterns as well.

In the embodiment described immediately below, the pattern-defining apertures are segmented and contoured such that the sampling of one set of apertures develops a triangular pattern of water coverage, and the simultaneous sampling of additional apertures develops a composite pattern of coverage which is rectangular. Simultaneous sampling of yet additional apertures develops a rectangular pattern of water coverage whose aspect ratio is variable, depending on the number of apertures sampled. As a result, the pattern of water coverage can be varied by sampling the outputs of selected apertures or combinations of apertures.

Referring now to FIG. 5, there is shown an exemplary water sprinkler 44 which develops predetermined but variable patterns of water coverage by sampling one or more selected pattern-defining apertures. The sprinkler 44 includes a base section 46 which may be circular and which has the water inlet port 48 disposed internally thereof.

A substantial portion of the water entering the inlet port 48 is constrained to flow through a flow regulator which normally determines the ultimate pattern of water coverage. In the embodiment shown in FIG. 5, the flow regulator includes a revolving sampling aperture in the form of a slit 68 and an upstanding hollow, cylindrical tube 52 integrally formed with the base 46 and having a plurality of pattern-defining apertures 54*a*, 54*b*, 54*c*, etc. The pattern-defining apertures 54 extend circularly around the outer periphery of the tube 52 and are individually contoured, as described in detail below, to develop various patterns of water coverage as the slit 68 revolves around the tube 52.

Disposed above and concentric with the tube 52 is a hollow, cylindrical head 56 whose internal diameter is somewhat larger than the outer diameter of the tube 52, whereby the head 56 may be fitted over the tube 52 concentrically as shown. A clearance (not shown) at an interface 58 between the tube 52 and the head 56 is maintained in order to permit relatively free rotation of the head 56 about the tube 52 and to permit the head 56 to be moved vertically with respect to the tube 52.

To adjust the head 56 to a predetermined vertical position with respect to the tube 52, a circular collar 62 is fitted around the lower portion of the head 56 and is coupled to the base 46 by threads 64. Thus, rotation of the collar 62 moves the latter vertically with respect to the tube 52.

As is described in more detail below, water pressure urges the head 56 upwardly so that a pressure plate 65 on the head 56 abuts a lower edge 62*a* of the collar 62. Accordingly, vertical motion of the collar 62 is followed by corresponding vertical motion of the head 56.

A small clearance (not shown) is left at the interface 66 between the lower portion of the head 56 and the collar 62, typically about five thousandths of an inch, to permit the head 56 to rotate freely within the collar 62.

Formed in the head 56 is the sampling aperture shown as the slit 68 which is disposed adjacent to and in combination with the apertures 54 in the tube 52. The slit 68 extends in the axial direction of the tube 52 so as to communicate both with a selected number of the apertures 54 as well as with a water conduit 70 located internally of the head 56. The slit 68 may have a width in the direction perpendicular to the plane of FIG. 5 of approximately 0.055 inch and, in any event, has a width which allows the slit 68 to communicate with only a small angular portion of each aperture 54 for any given instant of time.

The slit 68 is moved vertically to communicate only with selected apertures 54 by manually rotating the collar 62 with respect to the base 46. Such rotation causes the collar 62 to rotate in the threads 64 and to move vertically, thereby permitting the head 56 and the slit 68 to move upwardly under water pressure when the collar is rotated in one direction, and forcing the head 56 and the slit 68 downwardly when the collar 62 is rotated in the reverse direction.

To effect rotation of the head 56 and the slit 68, helical vanes 72 are fixed to the internal portion of the head 56 and disposed within the conduit 70 as shown. The vanes 72 are contoured in a conventional helical manner to impart rotational movement of the head 56 under pressure from upwardly moving water from the slit 68 and to permit the water to flow upwardly through the conduit 70.

When water enters the inlet port 48, it passes into the tube 52 and through the apertures 54 which communicate with the slit 68. The water emerges from the slit 68 and enters the conduit 70, whereupon it encounters the vanes 72. The pressure of the water on the vanes 72 rotates the head 56 so that the slit 68 rotates about the apertures 54, the latter of which extend circularly about the tube 52. This rotation enables the slit 68 to communicate with successive portions of the apertures 54 and sample the outputs thereof. Because the contour of each aperture generally varies as a function of its circular extension around the tube 52, the slit 68 passes a varying amount of water as it rotates.

In addition to rotating the head 56, the pressure of water on the vanes 72 also urges the head upwardly so that the pressure plate 65 is forced against the bottom edge 62*a* of the collar 62. Thus, the slit 68 is held at a predetermined vertical position with respect to the apertures 54 and communicates only with selected pattern-defining apertures. Although FIG. 5 illustrates the slit 68 communicating with all the apertures 54, it will be appreciated that rotation of the collar 62 in the correct direction will move the head 56 upwardly. Consequently, the slit 68 may be positioned to communicate selectively with one or more of the apertures 54.

Disposed at the top of the head 56 is nozzle 74 comprising an outlet port 76, a diffusing port 78, and an auxilliary outlet port 79. As shown, the outlet port 76 communicates with the conduit 70 such that most of the water flowing through the conduit 70 emerges from the outlet port 76.

Situated between the diffusing port 78 and the conduit 70 is a rotatable diffusing wheel 80. As shown more clearly in FIG. 6, the wheel 80 has a pair of S-shaped arms 82 disposed on either side of a central member 84. The peripheral surface of the member 84 is contoured as shown to have a diameter which gradually increases so that, as water impinges on the arms 82, the member 84 rotates on its shaft 86 for opening and closing the diffusing port 78. In operation, the wheel 80 rotates much faster than the head 56 so that the water which is expelled from the diffusing port 78 collides with water from the outlet port 76 so as to distribute water evenly from the sprinkler 44 to the periphery of the water pattern.

FIG. 7 illustrates the relative position of the wheel 80 with respect to the conduit 70. As shown, the shaft 86 may rotate within a pair of bearings 88.

The auxilliary port 79 communicates via an internal conduit 81 with a cavity 83 disposed under the pressure plate 65. In operation, a certain amount of leakage water passes through the apertures 54, into the interface 58 between the head 56 and the tube 52, and enter the cavity 83. Because the water which accumulates in the cavity 83 is under pressure, it rises through the conduit 81 and is expelled from the auxilliary port 79.

Although such leakage and its expulsion is not necessary for the practice of the invention, it is desirable in that it lubricates the interface 58 between the tube 52 and the head 56. Further, a small amount of leakage travels from the cavity 83 upwardly through the interface 66 between the head 56 and the collar 62, thereby lubricating the interface 66 to permit easier rotation of the head 56.

It is apparent that the amount of water exiting the ports 76 and 78 will vary as the slit 68 communicates with the circularly varying contours of the apertures 54. However, the amount of water exiting the port 79 is substantially constant, as is the leakage water from interface 58 into the conduit 70. The total amount of water from the slit 68 and the leakage from interface 58 is yet made to vary so as to develop predetermined patterns of water coverage by dimensioning the apertures 54 so as to take into account the total amount of leakage water. The apertures which are described hereinafter are dimensioned such that the resultant patterns of water coverage are developed from the leakage water from port 79, the leakage from interface 58 directly into the conduit 70 as well as the water passing through the slit 68.

Because the nozzle 74 and the slit 68 are both integral with the head 56, the slit 68 necessarily rotates in synchronism with the nozzle 74. Hence, for each angular position of the nozzle 74 there is a predetermined angular position for the slit 68. Thus, the flow of water from the nozzle 74 is dependent on the angular position of the slit 68 and the contour of the apertures 54 which the slit 68 samples.

Figure 8:
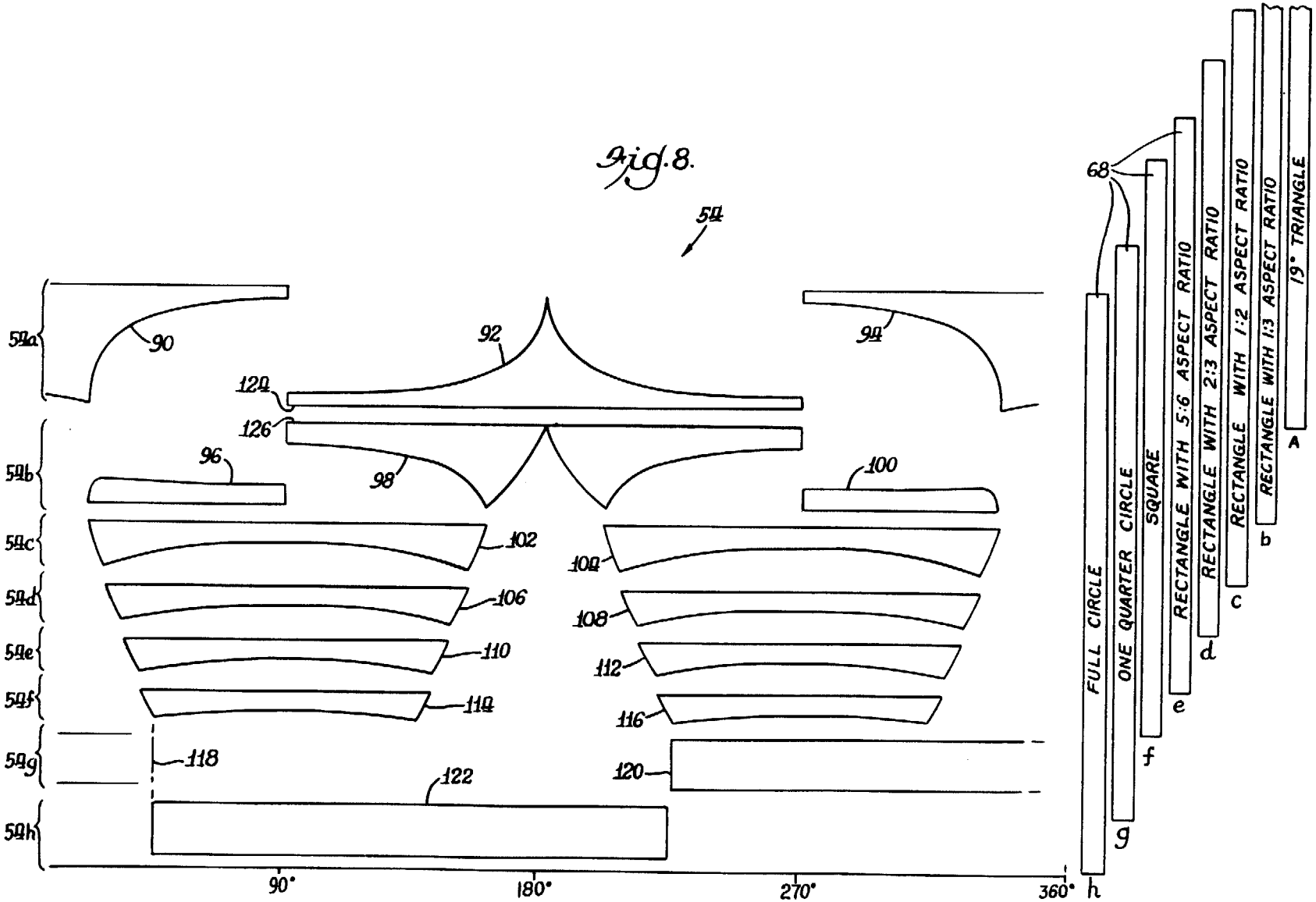
FIG. 8 is an unfolded, developmental view of exemplary pattern-defining apertures for use in the sprinkler of FIG. 5, illustrating a cummulative sampling of apertures to develop different patterns of water coverage.

Exemplary contours of the pattern-defining apertures 54 are shown in FIG. 8 as well as various vertical positions of the slit 68 for developing various patterns of water coverage. In this figure, the apertures 54 are shown as they would appear if the tube 52 were unfolded and laid flat. To the right of the apertures 54, the slit 68 is shown in various vertical positions wherein it communicates with different apertures 54.

As can be seen, most of the apertures 54 include a plurality or set of apertures. For example, the set **54*a* (corresponding to aperture 54*a* of FIG. 5) comprises apertures 90, 92, and 94 (actually, apertures 90 and 94 are continuous on tube 52). The sets of apertures 54*b* through 54*f* also each include at least two separate apertures. Only the sets 54*g* and 54*h* include but a single aperture. The reason for using a plurality of apertures in each set of apertures is to avoid using a single, continuous aperture which extends completely around the tube 52**. Such a continuous aperture would sever the tube into two parts and make it weaker and its contruction more difficult.

In general, each of the sets of apertures **54*a*–54*h* is contoured to develop a given pattern of water coverage. Moreover, the pattern developed by each set of apertures compliments the pattern developed by an adjacent set of apertures so that a given composite pattern is developed when multiple adjacent sets of apertures are sampled. Such contouring of the sets of apertures 54*a* –54*h* corresponds to the contouring of the apertures 16, 28, 32, 36, and 40 of FIG. 4** in that the latter, when segmented and cumulatively sampled as described hereinbefore, generate a composite pattern of water coverage.

Referring now to the set of apertures **54*a*, it can be seen that the aperture 90 extends around the tube 52 by 90, the aperture 92 extends from 90° to 270° around the tube, and the aperture 94 extends from 270° to 360° around the tube 52. Thus, as the collar 62 (FIG. 5) is adjusted so that the slit 68 communicates only with the set of apertures 54*a*, rotation of the head 56 will cause the slit 68 to sweep progressively across the apertures 90, 92, and 94. Consequently, the slit 68 samples the outputs of the apertures in the set 54*a* progressively and delivers to the outlet port 76 a flow of water dependent on the contour of the apertures 90, 92, and 94. That is, the water pattern coverage at each angular position of the outlet port 76 is related to the contour of the aperture being sampled by the slit 68**.

When the slit 68 is adjusted vertically to the position indicated at A in FIG. 8, it samples only the apertures within the set **54*a*. The apertures in the set 54*a* are contoured as shown so that the resultant pattern of water coverage corresponds to a triangle with the sprinkler at a point midway on the line of symmetry of the triangle. In addition, two of the included angles of the triangle are equal, the third angle being equal to 19. The apertures 90, 92, and 94** may, of course, be modified to develop other triangular patterns of water coverage.

Referring now to the set **54*b* of apertures 96, 98 and 100, this set of apertures is contoured such that when the slit 68 communicates with the sets of apertures 54*a* and 54*b* simultaneously, a rectangular pattern of water coverage is obtained, the rectangle having an aspect ratio of 1:3. This effect is obtained when the slit 68 is at the position indicated at B in FIG. 8. Thus, the sets of apertures 54*a* and 54*b*** individually define different water pattern coverages but their composite effect is to produce a rectangular pattern.

The aspect ratio of the rectangular water pattern coverage is varied by moving the slit 68 further vertically downwardly. For example, when the slit 68 is at the position indicated at C, the slit 68 additionally communicates with apertures 102 and 104 in the set **54*c***. In this condition a composite water pattern coverage corresponding to a rectangle having an aspect ratio of 1:2 is obtained.

The set **54*d* of apertures includes apertures 106 and 108 which are contoured such that a rectangular pattern of water coverage with an aspect ratio of 2:3 is obtained when the slit 68 is in the position d. In this position, the slit 68 communicates with all the apertures in the sets 54*a*–54*d***.

The set **54*e* includes apertures 110 and 112 which are contoured such that a rectangular pattern having an aspect ratio 5:6 is obtained when the slit 68** is in position e.

When the slit 68 is moved to position f, the apertures 114 and 116 in set **54*f* alter the composite water pattern to that of a square. Further downward movement of the slit 68 brings into play the apertures 118 and 120 in the set 54*g* (apertures 118 and 120 are actually one continuous aperture on tube 52**). Their contribution results in a composite pattern of water coverage corresponding to a quarter circle, as indicated at slit position g. The sprinkler itself will be positioned midway on the line of symmetry of the quarter circle.

The set **54*h* includes but single aperture 122. When the slit 68 is moved to position h, it communicates with the set 54*h*** and every other set of apertures to develop a circular pattern of water coverage.

It is noted that the apertures 118, 120 and 122 are rectangular in shape. That is, their contour does not vary as a function of their angular extension around the tube 52. However, the apertures 118, 120 and 122 are sized to permit a flow of water which is great enough so that the size of the water outlet 76 essentially controls the flow of water. That is, the size of the outlet 76 is the limiting factor in the flow of water. Consequently, an arcuate pattern is developed wherever the slit 68 communicates with one of the apertures 118, 120, or 122.

In the embodiment shown in FIG. 8, the apertures are contoured such that progressive upward or downward movement of the slit 68 progressively changes the composite water pattern developed. Accordingly, the slit 68 is made long enough to communicate with all sets of apertures to generate the composite pattern. However, the apertures need not be contoured so as to collectively generate a composite water pattern. For example, the apertures may include a first set 54*a* which develops a triangular water pattern, a second set of apertures vertically spaced from the first set and contoured to develop its own individual water pattern, rectangular for example. and other sets of apertures which are contoured to develop yet another water pattern. In that case, the slit may be made long enough only to communicate with a single set of apertures at one time. To change the pattern of water coverage, the slit would be moved to the appropriate set of apertures. In such an embodiment, there would not necessarily be the cooperation between sets of apertures to develop composite patterns. However, the preferred form is shown in FIG. 8 because many more patterns can be developed by apertures which can be closely stacked on the tube 52, thereby minimizing the length of the latter.

Referring again to FIG. 8, it will be noted that, according to another aspect of the invention, each of the pattern-defining apertures has at least one flat edge. For example, the apertures 92 and 98 have flat edges 124 and 126, respectively. By contouring the apertures to develop their desired pattern while yet having at least one flat edge enables the apertures to be closely stacked as shown, thereby further reducing the required height of the tube 52.

In the discussion above, a given pattern of water coverage was shown to be generated by causing the slit 68 to communicate with or overlap entirely a selected set or sets of apertures. However, the slit 68 may be adjusted to communicate with or overlap only a portion of a selected set or sets of apertures to develop a pattern of water coverage which is slightly different. For example, when the slit 68 is in position d (FIG. 9), it completely overlaps the sets of apertures 54*a*–54*d* to provide a rectangular pattern of water coverage having an aspect ratio of 2:3. However, the slit 68 may be moved upwardly in FIG. 8 so that it completely overlaps the sets of apertures 54*a*–54*c* and overlaps only the upper portions of the apertures in the set 54*d*. The latter position of the slit 68 will result in the development of a water pattern coverage which is generally rectangular but which has an aspect ratio between 2:3 and 1:2. Similar variations in the pattern of water coverage may be obtained by adjusting the slit 68 so that it partially overlaps another set of apertures.

Figure 9:
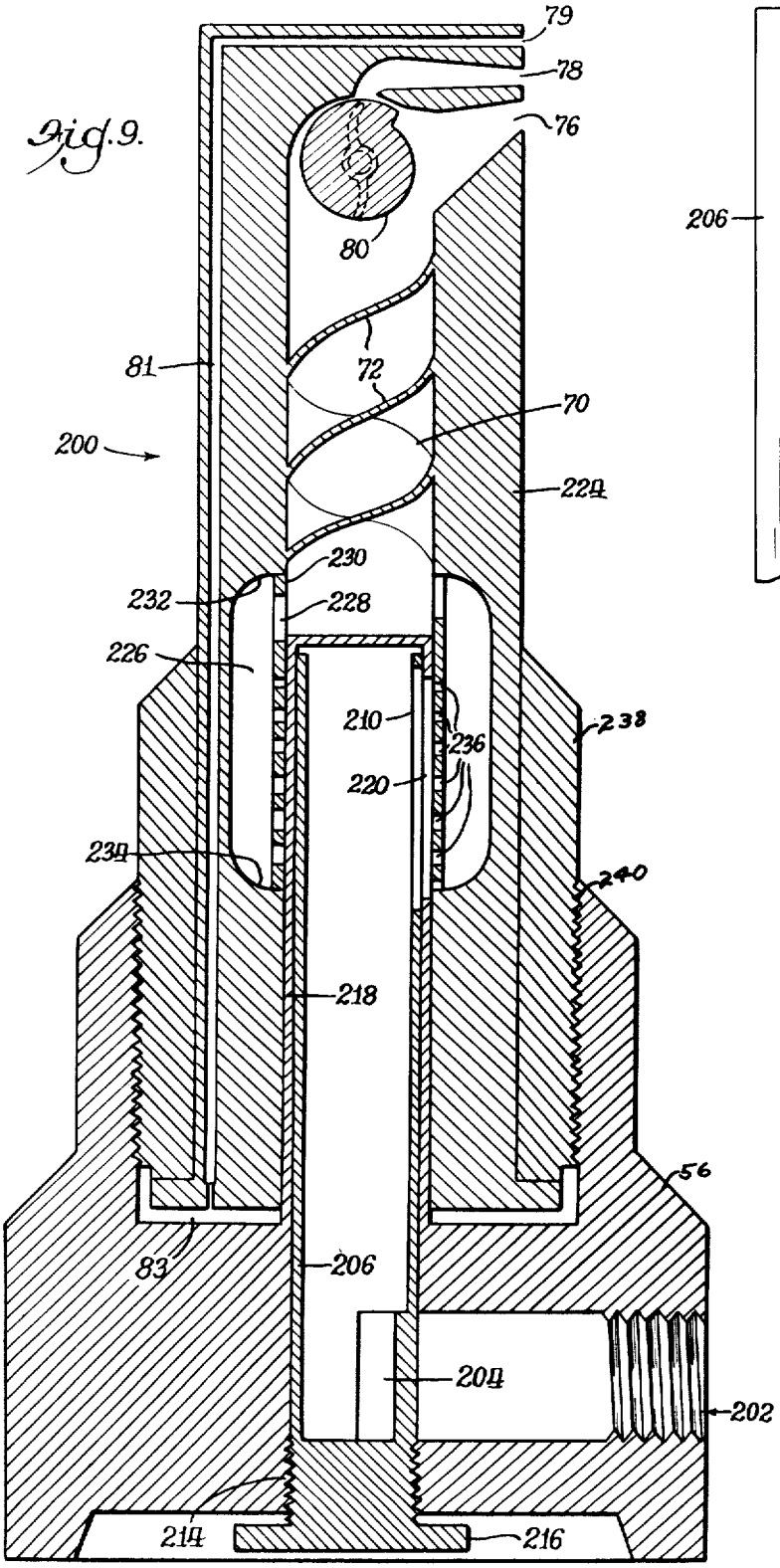
FIG. 9 is a sectional view of a second water sprinkler in a second embodiment of the invention.

A second embodiment of a sprinkler incorporating the present invention is shown in FIG. 9, wherein elements corresponding to those of FIG. 5 are given like reference numerals. The primary differences between the sprinkler shown in FIG. 9 and that shown in FIG. 5 are that, in FIG. 9 embodiment, the pattern-defining apertures rotate relative to fixed pattern-sampling slits, and an additional set of apertures is included to permit varying the size of a pattern of water coverage without substantially changing its configuration. Other differences will also be apparent from the discussion below.

In FIG. 9, a sprinkler 200 has a base 56 in which an inlet port 202 is bored for receiving water from a water source. Water which enters the port 202 passes through an entrance aperture 204 formed in a hollow, cylindrical tube 206 located internally of the base 56. The flow passage inlet is enclosed at the top and by the side wall of the tube 206 to constrain the water to flow through a sampling selector aperture 210 formed in the side wall of the tube 206.

Figure 10:
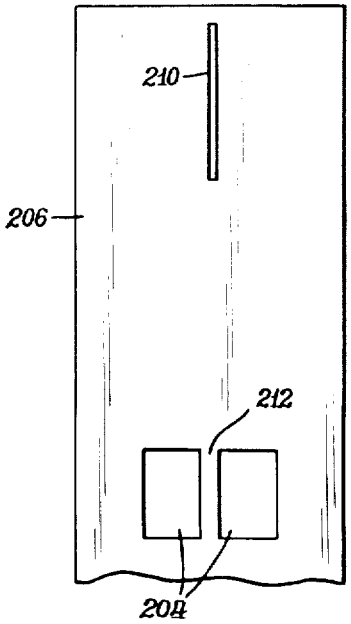
FIG. 10 is an unfolded, developmental view of a sampling means and its apertures used in the sprinkler tube of FIG. 9.

FIG. 10 shows the tube 206 unfolded and lying flat. As can be seen from this Figure, the entrance aperture 204 is split by a support post 212 which is integral to the tube 206 and serves to lend rigidity to the tube 206 in the vicinity of the aperture 240. The sampling selector aperture 210 is shown as being a vertically elongated, rectangular slit.

Referring again to FIG. 9, the tube 206 is threaded at 214 for engagement with mating threads in the base 56. The bottom of the tube 206 terminates in a knob 216 for manually rotating the tube 206 and its sampling selector aperture 210. As described in more detail below, the tube 206 and its aperture 210 constrain the flow of water from the inlet port 202 to flow through a selected one of a plurality of pattern-sampling apertures for selecting the desired size of water pattern coverage.

Surrounding the tube 206 is a pattern sampling means in the form of a hollow tube 218 formed integrally with the base 56. The sidewall of the tube 218 surrounds the sidewall of the tube 206 and is separated therefrom by a small clearance (not shown) to permit relative vertical movement of one tube with respect to the other. The top 208 of the tube 218 covers the tube 206 to constrain the water to flow through the selector slit 210.

Figure 11:
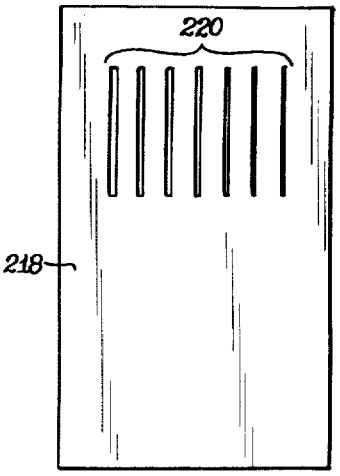
FIG. 11 is an unfolded, developmental view of a hollow tube bearing pattern sampling slits of various sizes.

The tube 218 further includes a plurality of sampling apertures in the form of elongated, vertically extending slits 220. FIG. 11 shows the tube 218 as it would appear if it were unfolded and more clearly shows the sampling slits 220.

In the embodiment shown, the slits 220 have similar lengths but different widths so that each slit 220 will pass a different amount of water in a given time interval. For example, the rightmost slit 220 is the narrowest slit and the leftmost slit is the widest. The intermediate slits 220 have widths which become progressively greater from right to left in the Figure.

As will be apparent in the description below of the operation of the sprinkler 200, preferably only one sampling slit 220 is in communication with the selector slit 210 at any given moment, the remaining sampling slits 220 being masked by the side wall of the tube 206.

Referring again to FIG. 9, the sprinkler 200 further includes a rotatable head 224 having an internally bored conduit 81 for passing leakage water from a cavity 83. Internally of the head 224 is a diffusing wheel 80, an exit port 76, a diffusing port 78, and an auxiliary port 79. Functionally, the conduit 81, cavity 83, diffusing wheel 80 and ports 76, 78, and 79 are equivalent to the similarly numbered elements of the FIG. 5 embodiment and are not, therefore, discussed in greater detail here.

The sprinkler head 224 also includes an internal cavity 226 which extends circularly of the head 224 as shown. The cavity 226 communicates with the main outlet conduit 70 via a circularly or helically extending apertures 228 in a web 230.

The web 230 extends vertically from an upper portion 232 of the cavity 226 to a lower portion 234 thereof and surrounds the upper portion of the tube 218.

The web 230 is perforated with at least one and preferably with a plurality of pattern-defining apertures 236, each of which extends circularly around the web 230 in close proximity with the sampling slits 220. The pattern-defining apertues 236 may be contoured as shown in FIG. 8 and may include a plurality of sets of apertures serving the function previously described with reference to the embodiment of FIG. 5.

In the embodiment of FIG. 9, however, the pertures 236 rotate with the head 234 so that they may be progressively sampled by one of the slits 220.

To place different apertures 236 in communication with one of the slits 220, a circular collar 238 is closely fitted to the head 224 and threaded to the base 56 by threads 240. By manually rotating the collar 238, that collar, the head 224, and the pattern-sampling apertures 236 are moved vertically with respect to the slits 220.

In operation, water introduced into the inlet port 202 flows upwardly into the tube 206. Assuming that the knob 216 has been rotated such that one of the selector slits 210 is aligned with one of the sampling slits 220, water flows through the selector slit 210 and through fthe sampling slit 220 which is aligned with the selector slit 210.

Water exiting a sampling slit 220 passes through those pattern-sampling apertures 236 which are in communication with the selected sampling slit 220.

After passing through one or more pattern-sampling apertures 236, the water flows into the cavity 226, through the aperture 228, and upwardly into the conduit 70. As the water impinges on the vanes 72 on its way to the outlet port 76, the pressure of the water on the vanes 72 causes the head 224 to rotate.

As the head 224 rotates, the pattern-sampling apertues 236 rotate about the selected sampling slit 220, whereby the latter samples progressive circular portions of the apertures 236 to generate a pattern of water coverage determined by the configuration of the sampled apertures 236. This generation of a water pattern coverage is like that described above with reference to the embodiment of FIG. 5.

To select a different pattern of water coverage, the collar 238 is manually rotated to bring other pattern-defining apertures into communication with the selected sampling slit 220, all as described above.

In order to vary the size of water pattern coverage without substantially changing its configuration, the knob 216 is manually rotated to bring the selector slit 210 into alignment with a different sampling slit 220. Now water flows through the selector slit 210 and the newly aligned sampling slit 220, and through the pattern-defining apertures 236 which are vertically oriented to communicate with that aligned sampling slit 220.

From the discussion above, it will be appreciated that the embodiment of FIG. 9 produces the same patterns of water coverage as the FIG. 5 embodiment while further permitting easy manual adjustment of the size of the water patterns.

The embodiments described above provide a number of advantages not generally found in prior sprinklers, particularly the ability to conform the pattern of water coverage to the size and shape of a selected area to be sprinkled. Thus, the amount of water used is minimized. Further, the pattern of water coverage is easily varied without disassembling the sprinkler.

An additional advantage is that the pattern of water coverage may be adjusted without requiring an operator to avoid the output of the sprinkler. For example, if a rectangular pattern of a given aspect ratio is desired, one would position the sprinkler midway on a line of symmetry of the area to be sprinkled, position oneself on the line of symmetry opposite the nozzle, and adjust the collar 66 and/or the knob 216 (in the FIG. 9 embodiment) to produce one-half the pattern, i.e., the pattern which lies in front of the operator. The pattern generated can be "fine tuned" by manually rotating the sprinkler head back to a starting position, readjusting the collar 66 and/or the knob 216, and releasing the sprinkler head to allow the sprinkler to re-define the half pattern again. Once the desired half pattern has been obtained, the operator may release the sprinkler head and allow it to rotate fully to define a pattern through 360° of rotation, including the second half of the pattern which was behind the operator when adjustments were being made. Because the second half of the pattern will be symmetrical with respect to the first half of the pattern, the over-all pattern will have been selected and adjusted without requiring an operator to dodge the spray while adjusting the sprinkler.

A third embodiment of the invention is shown in FIGS. 12 through 18. In this embodiment, briefly, a bi-directional spray head is employed to give additional spray pattern choices by using angularly adjustable stops and direction reverses. Contoured size-controlling apertures cooperate with the sampling aperture. A pattern shaper rotates with the pattern-forming apertures and is adjustable axially thereof. A secondary pattern generation means comprises a valve for providing additional fluid flow is added in parallel with the pattern selection devices of the above, primary pattern generation means. These additional features add to and enhance the features disclosed in the embodiments above to provide a vast increase in the flexibility of application of sprinklers, in accordance with the principles of the present invention.

Figure 13:
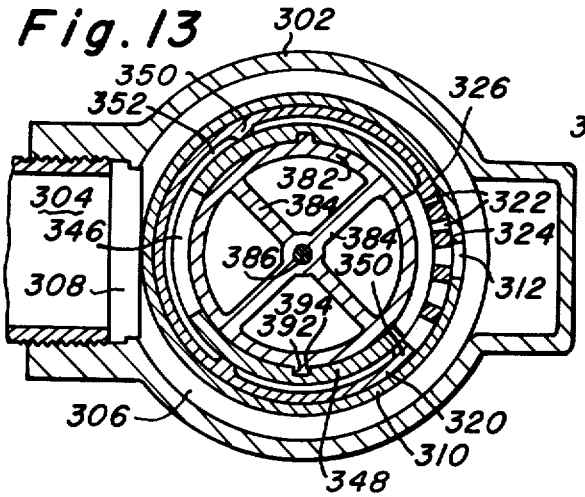
FIG. 13 is an axial sectional view taken on line 13—13 of the apparatus of FIG. 12.

FIG. 12 shows a sprinkler 300 comprising a sprinkler body 302. A water inet port and connection 304 and, as shown in FIG. 13, a water inlet annulus 306 provide water into the body. A filter 308 is interposed across the inlet 304 to remove any sizeable foreign particles from the water. An inner wall 310 of the annulus 306 is fixed in the sprinkler body 302 in watertight fashion about its edges, to define the inlet annulus 306.

Water which enters the sprinkler body 302 may flow through a fixed sampling aperture 312 formed as a vertical port through the wall 310. As shown in FIG. 13, the sampling aperture 312 is located opposite the inlet port 304 to provide improved flow characteristics through the sampling aperture 312.

Figure 14:
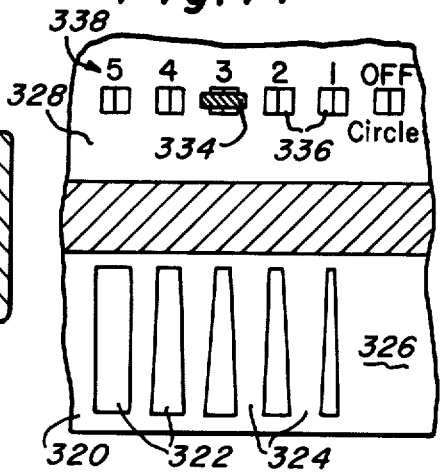
FIG. 14 is an unfolded, developmental view, on line 14—14 of FIG. 12, of the pattern-size apertures member.

Located radially inwardly of the first wall 310 and the sampling aperture 312 is a further cylindrical wall member 320, in facially-abutting relationship to the interior of the first wall member 310. As shown in FIGS. 12, 13 and 14, this second cylindrical member has a plurality of vertical apertures 322 formed there through, as well as closure lands 324 spacing the apertures 322 apart. Each aperture 322 is as large vertically or axially as the sampling aperture 312, but may be smaller in circumferential dimension to provide selectively for unrestricted or more restricted flow from the aperture 312 and into an interior chamber 302A of the sprinkler body 302. Such flow restriction controls the size of pattern produced by the sprinkler 300. In addition, a land 326 is formed on either side of the set of size-controlling apertures 322, for sealing the aperture 312 from the interior of the sprinkler body 302 entirely.

Further, as shown in FIG. 14, each of the reduced-size slits 322 is contoured circumferentially in width in the axial direction. Such contouring of the apertures provides improved pattern shape or definition among the range of sizes of patterns which can be formed using this embodiment of the invention.

The member 320 with the pattern size-controlling apertures 322 extends axially out of the sprinkler body 302 as shown in FIG. 12 and is manually accessible. The member 320 is thus selectively rotatably positionable with respect to the sprinkler body 302 via a threaded joint 330 or other connection. The parts 320 and 302 may be disassembled at the connection 330 for inspection and cleaning of the interior of the body 302. A retention spring 332 is cantilevered from the sprinkler body 302 and has a tip 334 which engages any one of a series of circumferentially-spaced apertures 336 about the part 328, for indexing and retaining the pattern size-controlling apertures 322 in a desired relation with the sampling aperture 312. Indicia 338 may be applied to the part 328 to indicate relative pattern sizes obtained at each retention point.

The radial positions of the sampling aperture member 310 and the size-controlling aperture member 320 may of course be interchanged without departing from the principles of the invention, as described above with respect to the first and second embodiments, but with some minor deterioration of the pattern definition. Thus, the pattern size-selecting aperture member 320 may be fixed as a wall of the inlet annulus 306 and the sampling aperture member 310 may be rotatably positionable with respect to the sprinkler body 302.

Figure 15:
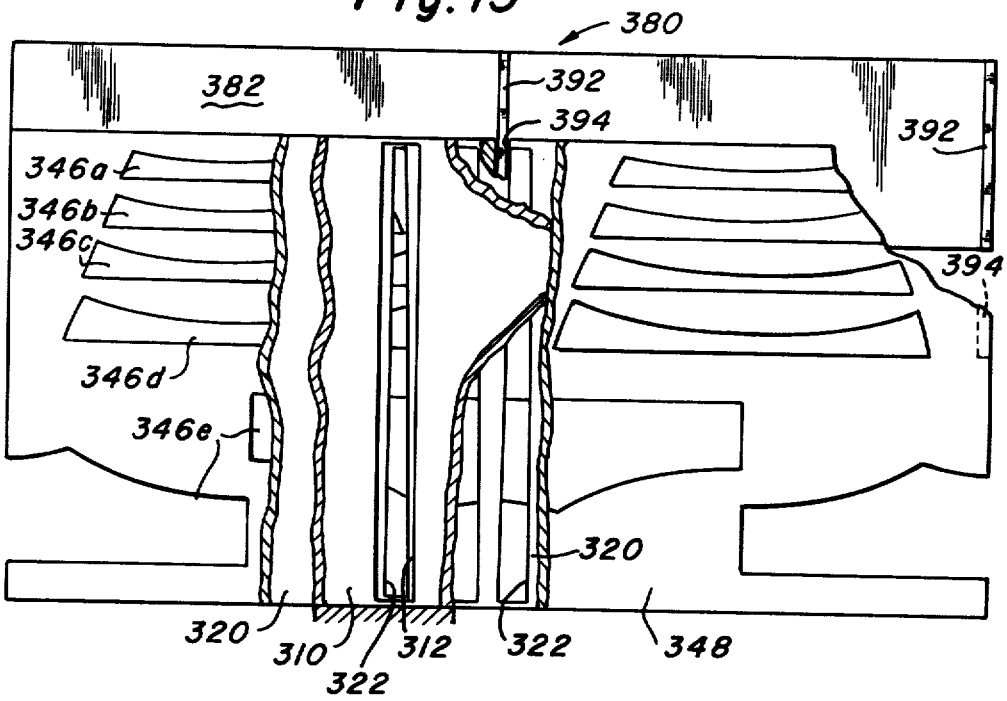
FIG. 15 is an unfolded, developmental view, partly broken away, about the inlet annulus of the apparatus of FIG. 12 and FIG. 13, showing the pattern apertures.

Located radially inwardly of the pattern size-controlling member 320 and carrying pattern-shaping apertures 346, is a further member 348 formed as a cylindrical wall which is rotatable with respect to the immediately-adjacent pattern-size member 320. The member 348 bears facially against inner lands 350 on the radially inward surface of the member 320 in sealing engagement therewith. Circumferentially adjacent portions of the inward face of the member 320 are recessed as at 352 to provide a clearance between the rotating and non-rotating members. As shown in FIG. 15, the member 348 with the pattern-shaping apertures 346 is formed according to the design principles of the apertures of FIG. 8, described in conjunction with the first embodiment above. Each of the circumferentially-adjacent sets of apertures 346*a, b, c,* and *d* provide different additions to or subtractions from the pattern of flow formed by the lowermost apertures 346*e*. Additional flow provided by the aperture pair 346*d* provides a different aspect ratio to the rectangular pattern by providing additional flow to certain portions of the basic pattern, as is the case where additional apertures c, b, and/or a are also opened for flow. p A substantial difference between the pattern-shaping apertures of FIG. 8 and that of FIG. 15 is that in FIG. 15, a narrow rectangular pattern is formed by the lowermost apertures 346*e* alone, whereas in FIG. 8, a full circle is provided by exposure of all the apertures of FIG. 8. This is because in the embodiment of FIGS. 5 and 8, flow through the sprinkler head is limited by the nozzle openings 76, 78, and 79, whereas in the third embodiment, of FIGS. 12 and 15, a full circle pattern is provided through an entirely different mechanism, described below. Thus, in FIG. 15, a narrow basic rectangular pattern is provided, and the aspect ratio provided by the water flow is decreased by the additional flow volumes provided by uncovering additional apertures d, c, b, and/or a. Of course, as described above, the apertures 346 shown are illustrative and not limiting. Any custom apertures or form or shape of apertures which define a desired spray pattern may be employed. What is important is, as described above, the cooperation of the various, vertically-stacked apertures, for providing desired flow patterns.

The cylindrical member 348 with the pattern-shaping apertures 346 is capped by an annular member 353 forming an outlet flow port or channel 354 directed axially of the sprinkler body 302. A conduit 356 is affixed to the annular member 353 and is journaled in the upper part 328 of the member 320. A water seal 358 closes leakage through the upper portions thereof while permitting leakage water to lubricate the bearing surfaces between members 356 and 238.

A reciprocable, bi-directional spray head 360 is fixed on the upper end of conduit 356. This reciprocating spray head 360 is of a known, conventional construction. A spray nozzle (hidden in the drawing) sprays into and through a weighted flapper assembly 362 which is journaled about the axis of the sprinkler body 302 and the conduit 356. Briefly, the flapper 362 is unstable in the stream of water from the nozzle, being first urged in the counterclockwise direction in the drawing by the stream of water impinging on the outer end thereof, and then being urged in the opposite direction by coil spring 364. The heavy flapper assembly 362 strikes sharply and with some force upon either a counterclockwise-urging member 366, via a stop pin 362*a*, upon deflection by the water stream or upon clockwise-urging member 368 upon return of the flapper 362 into the water stream by the spring 364. Such striking contact moves the spray head about its axis and through a small angle. If the stop 366 is in contacting position, the flapper 362 has insufficient momentum upon returning to the stop 368 to force the spray head 360 to rotate oppositely.

The counterclockwise stop 366 is moved into or out of contacting position with the pin 362*a* by a direction-reversing assembly 370. The assembly 370 comprises a toggle 372 which may contact one or another of angularly settable stops 374, 376, mounted on the relatively fixed upper part 328 of member 320, carried on the sprinkler body 302. The toggle 372 may be moved out of position from contacting the stops 374 and 376 for full, 360° rotation of the head 360. If the toggle 372 is in the position shown in FIG. 12, however, and contacts the stops, the striking force of the flapper 362 will cause the direction reversing assembly 370 to change the direction of angular movement of the spray head 360, as from counterclockwise to clockwise. Thus, spray is directed only over the arcuate portion of the area adjacent the sprinkler body 302 permitted by the setting of the angular stops 374, and 376.

A further pattern-shaping member 380 comprises a circumferential land 382 sealingly received within the member 348 defining the pattern-forming apertures 346 and a plurality of bracing arms 384. The member 380 serves as a pattern shaper, being vertically movable with respect to the member 348 and the pattern-forming apertures 346 under the control of a threaded rod 386 engaging a central portion of the arms 384. The threaded rod 386 is rotated by a manually-accessible handle 388 carried on an upper end thereof, extending above the spray head 360. An O-ring seal 390 prevents water leakage past the upper portion of the threaded shaft 386, within the spray head 360. The shaping member 380, the threaded rod 386 and the handle 388 all rotate or reciprocate with the spray head 360 and the member 348 while the sprinkler 300 is in operation.

For adjustment of the pattern shape, the spray head 360 is held fixed while the pattern shaper handle 388 is rotated. In the position shown in FIG. 12, the shaping member 380 is in its vertically upwardmost position, leaving all the apertures 346 a through e open to the flow of water through the sampling aperture 312 and the selected pattern size aperture 322. A square pattern is formed with the apertures as shown in FIG. 15. As the handle 388 and rod 386 are rotated with respect to the spray head 350, the shaping member 380 travels downwardly and its land 382 progressively covers one or more of the pattern-shaping apertures 346, for changing the aspect ratio of the rectangle from a square progressively to an elongated rectangle. The pattern shaper member 380 itself is prevented from rotating with respect to the spray head 360 and the pattern aperture member 348 by at least two tongues 392 formed longitudinally on an exterior surface of the circumferential land 382 which engage corresponding receiving grooves 394 formed on the interior surface of the pattern aperture member 348. Placing the lower edge of the pattern shaper member 380 partially across one of the pattern-forming apertures 346, may, depending on the particular shape of the aperture employed, provide an intermediate aspect ratio between having the aperture completely uncovered versus completely covered.

Further in accordance with the principles of the invention, in this third embodiment, a parallel, auxilliary or secondary pattern generation means 402 is provided in the base of the sprinkler body 302, communicating between the inlet annulus 306 and the interior chamber 302A, for direct communication of water to the outlet port 354. The secondary pattern generation means comprises a flow line 404 of a selected cross section and flow capacity and a valve 406 in the flow line, shown schematically in FIG. 12. The valve 406 is also selected as to its flow variation characteristics with respect to the volume characteristics of the flow passage 404.

For one purpose, the valve 406 permits fine-tuning of pattern definition as pattern size is varied. Thus, the apertures 322 are sized to provide step-wise increments of desirable sizes. A small supplemental flow through the valve 406 and the flow line 404 primarily affects pattern definition. Effects of pattern size and definition adjustment are shown diagramatically in FIG. 16, where the solid line 410 depicts a flow velocity profile over a 90° quadrant of rotation of the spray head 360. If the valve 406 is shut off entirely, the slightly reduced-flow velocity profile of dashed line 412 would be produced. If a larger aperture size is selected by rotation of the member 320, the velocity profile of the dotted line 414 would be produced, having a different pattern definition.

Figure 16:
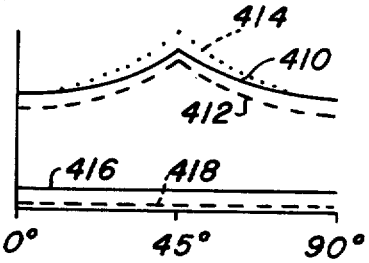
FIG. 16 is a diagrammatic representation of water output through one quadrant of rotation of the sprinkler nozzle of FIG. 12, showing possible variations to be effected in the water flow.

The valve 406 and flow line 404 may also serve an entirely different function besides fine pattern size definition adjustments. A circular flow pattern may be created entirely independently of the pattern-shaping apertures 346 if the flow line 404 and valve 406 have a maximum flow capacity substantially equal to that of the sampling aperture 312, the largest of the pattern size selector apertures 322, and the spray head 360. Thus, when the size selector member 320 is rotated so that the blocking land 36 covers the sampling apertures 312, no flow will be provided through the aperture 312 and through the member 350. Rather, all desired flow is then provided through the flow line 404 and valve 406, and the flow through the outlet port 354 will not depend upon the rotational position of the spray head 360. In this case, a circular flow pattern is developed of a size solely dependent upon the flow through valve 406. This is shown in FIG. 16, as solid line 406 or dashed line 418, representing parts of relatively small circular patterns in comparison to the square pattern of velocity profile 410.

Figure 17:
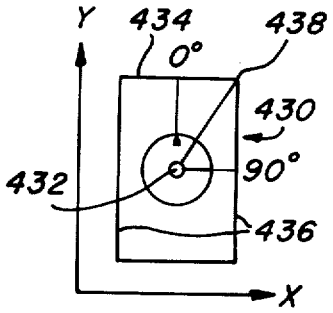
FIG. 17 is a diagrammatic view of a water spray pattern with check points for setting the sprinkler controls.

In operation, the water sprinkler 300 embodying the invention in its third form is adjusted for operation in the following manner. Assuming, as shown in FIG. 17, a rectangular area 430 to be sprinkled, the sprinkler 300 is set at a center 432 of the rectangle, midway between each of the short ends 434 and the long ends 436. The pattern shaper is set in its uppermost position, to create a square pattern. The sprinkler body 302 is set, preferably in accordance with an alignment mark placed on the body to align the sampling aperture 312 with the center of the pattern generating apertures 346, for spraying to a center of a perimeter side of the square. The sprinkler is then aimed manually along the Y axis, in the zero degree direction of FIG. 17. The water is turned on, and the water projection is set to coincide with the distance of the one perimeter 434 from the sprinkler location 432. This is accomplished by setting the pattern size selector member 320 to align a proper one of the pattern size apertures 322 with the sampling aperture 312.

Next, the sprinkler head 360 is rotated through 90° to direct a stream of water along the X axis. The pattern shaper member 380 is then moved downwardly by rotating the handle 388, to cover selected ones of the apertures 346 to restrict the spray only up to the sideline or perimeter 346. Thus, the aspect ratio of the rectangle 430 has been selected. Proper pattern definition is insured by directing the sprinkler spray to a corner 438 of the rectangle, and fine-tuning the flow valve 406 to match carefully the corner pattern. If necessary, finer adjustments may be made by moving the size selector member 320 and readjusting the opening of the valve 406 to achieve a very close registration to the desired pattern.

Finally, if less than a 360° pattern is to be sprayed, as to develop an L-shape or to spray quickly a small rectangle from one of its corners, the reversing toggle 372 is lowered to engage the stops 374 and 376, which are themselves adjusted to limit the sweep angle of the spray head 360. In fact, the stops 374 and 376, and the toggle 372 may desirably be preset during the initial adjustments to limit angular movement of the spray head 360, to avoid spraying the operator himself while he makes such adjustments.

FIG. 18 shows a number of patterns which can easily be generated with the sprinkler 300 at the positions shown by the crosses. The rectangular patterns 440 at the top of the figure are generated with the stop toggle 372 of the spray head 360 moved to an inoperative position to effect a 360° sweep of the area about the sprinkler. Sprinkler pattern **440*a* shows a number of squares which can be generated by the sprinkler of this third embodiment, wherein the pattern shaper member 380 is at its uppermost position, uncovering all the apertures 346*a–e*. The pattern size-controlling member 320 is rotated to the smallest of the apertures 322 for the innermost squares shown at 440*a*, with the sprinkler 300** set in the center of the area to be sprinkled.

Alternatively, a faster coverage of small areas may be provided by setting the sprinkler at a corner of the square area, adjusting the pattern size member 320 to a larger flow, and setting the sprinkler at a corner of the square area to be sprinkled with the angular stops 374 and 376 set to spray only a 90° sector of the square pattern. Very small square areas may be sprayed using this corner-spraying method with the smallest of the size-selection apertures 322. The other rectangular patterns 440*b–d* are provided by moving the pattern shaper member 382 axially along the rod 386.

The full circle pattern 440*g* is effected by rotating the pattern size controlling member 320 to block the sampling aperture 312 with the land 326 and by adjusting the seconndary flow valve 406 to provide a spray pattern of the desired size.

Many other patterns can be generated by the sprinkler 300 using the bi-directional spray head 360. L-shaped patterns 442*a* through *e* are achieved by setting the sprinkler to a square or to a rectangular pattern of the desired aspect ratio, and then adjusting the stops 374 and 376 to provide a 270° spray pattern. The narrow rectangular and semi-circular patterns 442*f* and *g* use a 180° rotation, with other settings the same as those for the patterns 442*e* and 440*g*, respectively. Similarly, the triangles of patterns 444 and 448 and the somewhat irregular quadrangles of patterns 446 are formed by setting the sprinkler at the points shown by the crosses 300 and then setting the pattern size and angular stops to provide the desired patterns. Many other regular and irregular patterns can be effected having one or more straight sides or one curved side, as may be readily appreciated from the typical disclosures herein.

It is also a feature of this third embodiment of the invention in the sprinkler 300 that the parts of the device may readily be disassembled for inspection and cleaning. The movable inner parts including the pattern defining aperture member 348 and the pattern size selecting member 320 are removable from the sprinkler body 302 at the screw thread 330. The sprinkler 300 as shown is axially or vertically compact even in use due to the movable shaper member 380 and the axially fixed members 350 and 320. Other distinct advantages in construction and operation readily appear from the embodiment shown.

Although exemplary structures and aperture contours have been illustrated, the invention may be practiced using many alternate structures and aperture contours. For example, the aperture contours shown in FIGS. 8 and 14 may be modified to generate a large variety of patterns. Moreover, they may be "customized" to develop water patterns corresponding to irregularly shaped yards.

Further, a sprinkler according to this invention in any of its embodiments as shown is not limited to a single sampling slit having relative rotation with respect to a set of apertures which extend completely around a tube. For example, in the FIG. 5 embodiment, a pair of oppositely disposed slits may be used in connection with pattern-defining apertures which extend only half way around the tube. Moreover, the pattern sampling aperture need not be in the form of a slit. Rather, it may take any appropriate form which allows it to cooperate with circularly extending, pattern-defining apertures so as to integrate the contour of the pattern-defining apertures to develop a desired pattern coverage.

Many other modifications and alterations will be apparent to those skilled in the art in light of this disclosure. Accordingly, it is intended that all such modifications and alterations be included within the spirit and scope of the invention as defined by the appended claims.

I claim as my invention:

1. A water sprinkler for distributing water over a desired area of regular or irregular shape, the sprinkler comprising:

a sprinkler body adapted for fixed placement with respect to said area;

a spray head mounted rotatably upon said sprinkler body;

a water inlet port formed in said sprinkler body and communicating to a pressurized source of water;

a water outlet port in said sprinkler body communicating to said spray head;

primary pattern generation means for controlling the pattern of water distribution from said spray head, said primary pattern generation means comprising:

a first member defining a sampling aperture communicating to said inlet port, and a second member defining at least two pattern-forming apertures one or more of which communicate to at least a portion of the sampling aperture, the area of each pattern-forming aperture which communicates to the sampling aperture being limited to regulate the volume of water flowing through said second member from the sampling aperture, and a third member comprising a land area in facially-sealing relationship to said second member and which is movable selectively to close from none to all of said pattern-forming aperture(s), and wherein one of the first and second members rotates with the spray head while the other is relatively fixed in the sprinkler body; and secondary pattern generation means for adjusting the definition of the pattern of water distribution, the secondary pattern generation means comprising a variable flow port communicating between the water inlet and water outlet ports in parallel with the flow through the sampling and pattern-forming apertures, whereby the shape and size of the distribution pattern may easily be regulated.

2. A water sprinkler as defined in claim 1, wherein the primary pattern generation means further comprises a fourth member disposed in facially sealing contact relation with at least one of the first and second members and forming a plurality of spaced pattern size-controlling apertures, the size-controlling apertures limiting the flow through the sampling aperture and thus controlling the size of the pattern.

3. A water sprinkler as defined in claim 2, wherein at least one of the apertures of the fourth member is formed as an elongated slit contoured in width from end to end.

4. A water sprinkler as defined in claim 2, wherein the fourth member further comprises a valve land means for closing the sampling apertures entirely, and wherein the flow port of a secondary pattern generation means is openable to pass a substantial flow, whereby to provide a circular flow pattern using solely the secondary pattern generation means without use of any of the specially-designed pattern selector apertures in said second member.

5. A water sprinkler as defined in claim 1 or in claim 2 or in claim 4, wherein said spray head includes means for driving it angularly in either direction about a vertical axis and further comprises settable angular stops and direction-reversing means, whereby the sprinkler may selectively cover an area of less than 360° from the sprinkler placement position and of selected regular and irregular shapes.

6. A water sprinkler for distributing water over a desired pattern, the sprinkler comprising, in combination, a spray head which automatically moves reciprocally in either direction about a vertical axis and which includes angular stops and means for reversing the direction of rotation of the spray head;

a fixed sprinkler body defining a pressurized water inlet port and a water outlet port directed into said reciprocable head; and a water valving and pattern generation means for controlling the pattern of water distribution through said spray head, the generation means comprising:

a first member defining a sampling aperture in communication with said inlet port, a second member defining at least two pattern-forming apertures, each said pattern-forming aperture having a limited passage communicating with the sampling aperture to regulate the volume of water flowing through the second member and wherein one of the first and second members rotates with the reciprocable spray head, and a third member comprising a valve land which is selectively movable to block flow from at least one of said pattern-forming apertures, whereby to permit selection of a pattern to be produced by the sprinkler.

7. A water sprinkler as defined in claim 6, wherein the second member, having pattern-forming apertures, rotates with the spray head and the first member is relatively fixed in the sprinkler body.

8. A water sprinkler as defined in claim 7, wherein each of the first and second and third members is annular in form and extends about said vertical axis and wherein the second member comprises at least two cooperating pattern forming apertures axially spaced from one another.

9. A water sprinkler as defined in claim 8, further comprising a fourth annular member disposed in facially sealing contact with at least one of the first and second members, the fourth member being circumferentially positionable with respect to the sampling aperture of the first member, and the fourth member having formed therein a plurality of spaced, pattern size-controlling apertures which pass selectively from some to all of the flow through the sampling aperture to the pattern-forming apertures of the second member.

10. A water sprinkler as defined in claim 9, wherein the pattern size-controlling aperture is elongated in the axial direction and is contoured in circumferential width from one end to the other.

11. A water sprinkler as defined in claim 9, further comprising a secondary pattern generation means comprising a flow line between the water inlet and water outlet in parallel with flow through the sampling aperture and pattern-forming apertures, and a valve in said flow line for controlling the amount of flow through said line, whereby to provide for fine adjustments to the definition in said pattern.

12. A water sprinkler as defined in claim 11, wherein:

said first member is formed as a fixed, inner wall of the inlet port of said sprinkler body and said sampling aperture is formed through said wall;

said second member is formed as a cylindrical wall inwardly of said first member and is affixed to said spray head for rotation therewith; and said third member is formed as an annular wall and is carried by said spray head and said second member for selected axial positioning with respect thereto and for rotation with said second member.

13. A water sprinkler as defined in claim 12, wherein said axial position of the third member is determined and controlled by a threaded shaft engaged therewith and extending outside the spray head for manipulation.

14. A water sprinkler as defined in claim 11, wherein said fourth member is formed as a cylindrical wall and is interposed in part between the first and second members and is selectively fixed in the sprinkler body with one of a blocking land and said apertures in communication with said sampling port.

15. A water sprinkler as defined in claim 14, wherein a part of the fourth member is manually accessible on the exterior of the sprinkler body for rotatably positioning and repositioning same for selective alignment of said land and said apertures with the sampling port.

16. A water sprinkler as defined in claim 11, wherein the valve has a variable flow capacity which is small in relation to the flow through the pattern-forming apertures, for fine-tuning the pattern size and shape together with the selective positioning of the fourth member.

17. A water sprinkler as defined in claim 11, wherein the valve has a maximum flow capacity which is at least substantially equal to the flow through the larger of the sampling aperture and the largest of the pattern-forming apertures, whereby alone to effect a circular or part-circular distribution pattern without flow through the pattern-forming apertures.

* * * * *